United States Patent [19]

McLaughlin, Jr.

[11] 4,256,602

[45] Mar. 17, 1981

[54] FLUOROBORATE COMPLEX COMPOSITION AND METHOD FOR CLEANING ALUMINUM AT LOW TEMPERATURES

[75] Inventor: Hugh D. McLaughlin, Jr., Somerdale Camden, N.J.

[73] Assignee: Pennwalt Corporation, Philadelphia, Pa.

[21] Appl. No.: 965,720

[22] Filed: Dec. 1, 1978

[51] Int. Cl.[3] ..... C11D 7/08

[52] U.S. Cl. ..... 252/142; 134/3; 134/41; 156/665; 252/79.3

[58] Field of Search ..... 252/142, 143, 144, 145, 252/79.3; 134/3, 41; 156/665

[56] References Cited

U.S. PATENT DOCUMENTS

| | | | |
|---|---|---|---|
| 2,719,079 | 9/1955 | Murphy | 252/142 X |
| 3,106,499 | 10/1963 | Kendall | 156/665 |
| 3,220,899 | 11/1965 | Leonard | 156/665 X |
| 3,228,816 | 1/1966 | Kendall | 156/665 |
| 3,331,710 | 7/1967 | Lodeesen et al. | 156/665 X |
| 3,969,135 | 7/1976 | King et al. | 252/142 X |
| 4,009,115 | 2/1977 | Binns | 252/142 |
| 4,116,853 | 9/1978 | Binns | 252/142 |
| 4,124,407 | 11/1978 | Binns | 252/142 X |

OTHER PUBLICATIONS

Handbook of Chemistry and Physics, 44th Ed., Chemical Rubber Publishing Co., Cleveland, Ohio 1963, pp. 664–665.

*Primary Examiner*—Harris A. Pitlick

[57] ABSTRACT

A composition of fluoroborate complex and sulfuric acid and wetting agents is used for cleaning aluminum surfaces.

4 Claims, No Drawings

FLUOROBORATE COMPLEX COMPOSITION AND METHOD FOR CLEANING ALUMINUM AT LOW TEMPERATURES

BACKGROUND OF THE INVENTION

1. Field of the Invention

This invention relates to a composition of fluoroborate complex and sulfuric acid containing wetting agents for cleaning containers comprised of aluminum and alloys thereof.

2. Description of the Prior Art

Containers comprised of aluminum and alloys thereof are produced in a drawing and forming operation, referred to as drawing and ironing, which results in the deposition of lubricants and forming oils on the surface. In addition, residual aluminum fines, i.e., small particles of aluminum, are deposited on the interior and exterior surfaces of the container during the forming operation. Prior to any processing steps, such as conversion coating and sanitary lacquer deposition, the surfaces of the aluminum containers must be cleaned and water-break-free so that there are no contaminants which prevent further processing and which render the containers unacceptable for use.

Acid cleaners including hydrofluoric acid and boric acid have been employed to clean aluminum surfaces and to remove aluminum fines deposited thereon. U.S. Pat. No. 4,009,115 employs sulfuric acid and hydrofluoric acid to clean aluminum surfaces at temperatures of 90° to 135° F. and a pH less than 2. No where in the reference does the combination include a boric acid component or a fluoroborate component such as taught in the instant invention. U.S. Pat. Nos. 3,228,816, 3,106,499, and 2,682,502 teach the cleaning of aluminum surfaces employing nitric acid cleaners combined with hydrofluoric acid and boric acid. These references, nevertheless, use high temperatures in the range of 160° to 212° F. in order to remove dissolved aluminum fines and to remove the lubricant forming oils so that the surface is rendered water-break-free. Because of the high temperatures at which cleaning is accomplished, the processing equipment employed to heat the cleaning compositions, particularly the fire tubes of gas fired heat exchangers, are susceptible to corrosion. Furthermore, the high temperatures increase operating costs and fuel consumption. The fluoride when present in high concentrations can attack the metal surfaces and etch the surface which is undesirable, especially when cleaning of containers is to be effective. Moreover, none of these references teach the use of sulfuric acid in their cleaning solutions. The present invention overcomes all of the above mentioned disadvantages.

STATEMENT OF THE INVENTION

The present invention is directed to an aqueous cleaning and etching composition for removing and dissolving aluminum fines and cleaning lubricating oils from aluminum surfaces comprising from about 0.5 to 2.0% by volume of cleaning solution comprised of sulfuric acid and wetting agents and from about 0.005 to 0.10% by volume of an additive fluoroborate complex derived from reacting hydrofluoric acid with boric acid in a ratio 1.2 to 1.

DETAILED DESCRIPTION OF THE INVENTION

The present invention is directed to a cleaning solution having relatively low concentrations of fluoroborate, which can be easily controlled and which enables the cleaning of aluminum surfaces. The aluminum surface is cleaned of lubricant and metallic fines at temperatures as low as from about 80° to about 130° F. and a pH in the range of from 0.8 to 1.5.

It should be understood that the term "aluminum surface" used herein includes aluminum and aluminum alloys in which aluminum is the principal constituent. It should also be understood that the terms "cleaning composition" or "cleaning solution" mean the aqueous acidic cleaning bath of the present invention consisting essentially of a cleaning solution comprised of sulfuric acid and wetting agents and a fluoroborate additive.

The unexpected results obtained with the use of this cleaning solution include the removal and dissolution of aluminum fines from a formed aluminum container, both on the interior walls and dome of said container, at lower concentrations than the prior art. Tests also indicate that at the same concentration the fluoroborate complex is more efficient than the comparable concentration derived from hydrofluoric acid. The amount of additive required is less; the number of additions is decreased and the quantity of aluminum removed in a given period of time is greater with fluoroborate complex than with fluoride generated from hydrofluoric acid.

The acid fluoride complex is a necessary constituent which is responsible for assisting in dissolution of the aluminum fines and oil film removal. In the present cleaning process, it is essential that the active fluoride be maintained within specified limits, since the active fluoride affects the aluminum fine dissolution and oil film removal. The term "active fluoride" means the fluoride present in the operating cleaning solution and measurable at a given pH and temperature by a fluoride sensitive electrode of the potentiometric type. Since the active fluoride in the instant invention is introduced by way of the fluoroborate complex, it has been found that this complex makes the active fluoride more efficient as noted above.

The cleaning composition of the present invention is applied by spray wash at a pressure of 15 to 60 pounds per square inch gauge (psig). The active fluoride concentration should be in the range of about 0.5 to 1.5 ppm.

Surfactants and other components that may be present in the cleaning composition are:

1. PLURAFAC RA-30—is a biodegradable surfactant, that has a clear colorless liquid appearance, a specific gravity at 25/25° C. of 0.973, weighs 8.1 pounds per gallon at 25/25° C., has a pH in 1% aqueous solution of 6 to 7, has a flash point of 455° F. and fire point of 520° F., it is marketed by BASF-Wyandotte Chemicals Corporation.

2. SYN FAC TEA-97—is an ethoxylated amine that is a solvent and dispersant for acidic materials. Also effective as a dispersant in soap formulations when used as emulsifiers. It has a specific gravity (25° C.) of 1.10, a pH (in 10% of water) of 8.4 and viscosity at 25° C. of 400 cps. It has a golden brown odorless liquid appearance, is completely soluble in water, and weighs 9.16 pounds per gallon. It is marketed by Milliken Chemical Corporation.

3. PLURONIC 25-R-2—is a water soluble, low foaming non-ionic wetting agent chemically described as a polyoxyethylene polyoxypropylene condensate. It has a specific gravity at 25/25° C. of 1.039±0.005, a pour point of −5° C., a cloud point (1% solution) of 33° C., a flash point (COC) of greater than 50° F., a refractive index at 25° C. of 1.4541 and a brookfield viscosity of 25° C. of 680 cps. It is marketed by BASF-Wyandotte Corporation.

4. ANTAROX BL-225—is a low foaming biodegradable non-ionic surfactant which is a linear alcohol polyester with an activity of 100%. It is a clear slightly yellow liquid in appearance; it has a viscosity (at 77° F.) of 450 cps, a cloud point of 79° F., a pour point of −20° F., a pH (10% solution) of 6.5, and a specific gravity of 0.985; it weighs 8.21 pounds per gallon. It is marketed by General Aniline and Film Corporation.

5. SORBITOL—has the formula $C_6H_{14}O_6 \cdot \frac{1}{2}H_2O$ and is named 1,2,3,4,5,6-hexane hexol. It is an alcohol isomer of mannitol from sorbus aucuparia which is a colorless crystal that is soluble in water and alcohol and has a melting point of 111° C.

A cleaning composition of the instant invention is composed of a cleaner and an additive of the following formulas:

| Ingredient | % By Weight |
|---|---|
| **Cleaner** | |
| Sulfuric Acid (41.1 Be') | 93.0 to 88.0 |
| Sorbitol Solution (70%) | 3.5 to 4.5 |
| Syn FAC TEA 97 | 1.0 to 2.0 |
| Antarox BL225 | 1.0 to 2.0 |
| Pluronic 25R2 | 0.5 to 1.5 |
| Plurafac RA30 | 1.0 to 2.0 |
| **Additive** | |
| Water | 97.3 to 0.0 |
| Hydrofluoric Acid (70%) | 1.7 to 62.9 |
| Boric Acid | 1.0 to 37.1 |
| Ratio of HF to Boric Acid should be 1.2 to 1. | |

Cleaning is accomplished by a concentration of 0.5 to 2.0% by volume of Cleaner and 0.005 to 0.1% by volume of Additive.

The metal surface should be cleaned employing techniques that result in a completely water-break-free surface. The cleaning solution can be applied to the aluminum surface using any of the contacting techniques known to the art. Preferably, the surface should be treated for a time from about 15 seconds to about 2 minutes. Most preferred treatment is 45 seconds to 60 seconds.

The aluminum fines and forming oils are removed from the aluminum surface by the cleaning solution at temperatures lower than ordinarily expected. The cleaning process can be operated at temperatures from about 110° F. to about 125° F. Most preferred results are obtained when the cleaning process is operated at temperatures from about 120° F. to about 125° F.

In accordance with the invention, the cleaning solution is highly acidic, having a pH of from 0.8 to 1.5. The amount of sulfuric acid and fluoroborate can be varied within limits in accordance with the ranges set forth hereinabove so that the pH of the cleaning solution can be adjusted.

The following example illustrates the present invention but is not intended to limit the invention thereto.

EXAMPLE 1

| Ingredient | % By Weight |
|---|---|
| **Cleaner** | |
| Sulfuric Acid (41° Be') | 92.0 |
| Sorbital Solution (70%) | 4.0 |
| Syn FAC TEA 97 | 1.0 |
| Antarox BL225 | 1.0 |
| Pluronic 25R2 | 0.5 |
| Plurafac RA30 | 1.5 |
| **Additive** | |
| Water | 42.4 |
| Hydrofluoric Acid (49%) | 40.9 |
| Boric Acid | 16.7 |

Aluminum container test specimens of 3004 alloy were employed in this procedure. The containers had been subjected to a drawing operation and were covered with aluminum fines.

The interior and exterior surfaces of the cans were initially cleaned by spraying with the solution listed in Example 1.

In order to determine rate of aluminum etch and comparative fluoride consumption, small samples averaging 2.5 cm by 1.7 cm were cut from the treated cans.

Baths were made up consisting of the following formulas:

| | Weight (gms) |
|---|---|
| **Formula I** | |
| Sulfuric Acid | 4.0 |
| Hydrofluoric Acid (as HF) | 0.1 |
| Water to make 1 liter | |
| **Formula II** | |
| Sulfuric Acid | 4.0 |
| Fluorborate Complex (as $BF_4$) | 0.1 |
| Water to make 1 liter | |

The small samples of 3004 aluminum cut from the cleaned cans were weighed and area was determined. The fluoride activity of both solutions were measured using fluoride specific ion electrodes of the potentiometric type at 75° F. The baths were heated to 120° F. with slight agitation. The samples of 3004 aluminum were then immersed in the bath for a period of 10 minutes. The samples were then washed in deionized water and oven dried. These were then re-weighed and the amount of aluminum removed per unit area was determined. The fluoride activity of the bath was also determined. Results of this experiment can be found in Table 1.

TABLE 1

| | Millivolt Reading (75° F.) | | | Weight Loss/cm²/ |
|---|---|---|---|---|
| | Initial | Final | Change | 10 min. |
| Formula I | −13.0 | −7.0 | 6.0 | $8.0 \times 10^{-4}$ gms |
| Formula II | +15.0 | +18.0 | 3.0 | $11.0 \times 10^{-4}$ gms |

These data indicate that under the same conditions of concentration and temperature the fluoroborate complex not only etches more aluminum but also maintains the fluoride concentration more efficiently.

Additional small samples of 3004 aluminum were cut from the cans cleaned as above. Bath solutions were made up consisting of the following formulas. The cleaner & additive used have the composition of Example 1. Adjustments were made to the concentration so that the acid content and fluoride content were equal in all formulas.

The samples of 3004 aluminum were then immersed in the bath for 10 minutes at 120° F. The samples were then washed and oven dried and reweighed. The amount of aluminum removed per unit area could then be determined.

| Formula I | | Formula II | |
|---|---|---|---|
| $NH_4F \cdot HF$ | 2.0 grams | $NH_4 \cdot HF$ | 2.0 grams |
| $H_3BO_3$ | 10.0 grams | $H_3BO_3$ | 10.0 grams |
| $HNO_3$ | 42.6 grams | Cleaner | 71.3 grams |
| Water to make 1 liter | | Water to make 1 liter | |
| **Formula III** | | **Formula IV** | |
| $HNO_3$ | 42.6 grams | Cleaner | 71.3 grams |
| Additive | 7.9 grams | Additive | 7.9 grams |
| Water to make 1 liter | | Water to make 1 liter | |

The results of this work may be found in Table II.

TABLE II

| Identification | Weight Loss (gms/cm$^2$) |
|---|---|
| Formula I | $12.7 \times 10^{-4}$ |
| Formula II | $4.0 \times 10^{-4}$ |
| Formula III | $11.4 \times 10^{-4}$ |
| Formula IV | $4.95 \times 10^{-4}$ |

These data indicate that under the condition of the test, the etch rate is primarily a function of the acid used.

What is claimed:

1. An aqueous cleaning composition for removing and dissolving aluminum fines and cleaning lubricating oils from aluminum surfaces consisting essentially of from about 0.5 to 2.0% by volume of cleaning solution comprised of 93 to 88% by weight of 41.1°Be' sulfuric acid and 7 to 12% by weight of wetting and dispersing agents and 0.005 to 0.10% by volume of fluoroborate complex derived from reacting hydrofluoric acid with boric acid in a ratio of 1.2 to 1 by weight.

2. The composition of claim 1 wherein the pH is from about 0.8 to 1.5.

3. The composition of claim 1 wherein the wetting agents are selected from the group consisting of non-ionic and anionic surfactants.

4. Process of cleaning two-piece aluminum cans comprising the application of cleaning composition of claim 1 for a time of about 15 seconds to about 2 minutes to the cans by spraying at a temperature range of about 80° F. to about 125° F.

* * * * *